US005509161A

United States Patent [19]

Neveu et al.

[11] Patent Number: 5,509,161

[45] Date of Patent: Apr. 23, 1996

[54] IMPREGNATION PROCEDURE FOR A TEXTILE SHEET

[75] Inventors: Jean-Louis Neveu, Lery; Didier Dumas, Aviron, both of France

[73] Assignee: Kaysersberg, France

[21] Appl. No.: 934,513

[22] PCT Filed: Apr. 10, 1991

[86] PCT No.: PCT/FR91/00290

§ 371 Date: Dec. 9, 1992

§ 102(e) Date: Dec. 2, 1992

[87] PCT Pub. No.: WO91/05622

PCT Pub. Date: Oct. 17, 1991

[30] Foreign Application Priority Data

Apr. 11, 1990 [FR] France ..... 9004647

[51] Int. Cl.[6] ..... D06B 5/08

[52] U.S. Cl. ..... 8/151; 68/250 R; 8/156

[58] Field of Search ..... 68/205 R, 200, 68/19, 19.1; 8/151, 156; 134/122 R, 64 R, 199; 210/400, 401; 162/208, 297, 308, 314, 310, 60

[56] References Cited

U.S. PATENT DOCUMENTS

| | | | |
|---|---|---|---|
| 3,161,522 | 12/1964 | Compton | 210/401 |
| 3,426,908 | 2/1969 | Davis et al. | 210/401 |
| 3,565,756 | 2/1971 | Kashiwabara et al. | 162/297 |
| 3,964,860 | 6/1976 | Leifeld | 8/151 |
| 3,997,928 | 12/1976 | Leifeld | 8/151 |
| 4,076,222 | 2/1978 | Schaming | 134/64 R |
| 4,154,644 | 5/1979 | Ericsson | 210/400 |
| 4,213,217 | 7/1980 | Kretschmer et al. | 8/151 |
| 4,213,218 | 7/1980 | Winch | 8/156 |
| 4,500,032 | 2/1985 | Pacifrc et al. | 68/205 R |
| 4,539,827 | 9/1985 | Klein et al. | 162/310 |
| 4,569,762 | 2/1986 | Gaudfrin | 210/401 |
| 4,608,122 | 8/1986 | Klein et al. | 68/205 R |
| 4,719,772 | 1/1988 | Bastanzuri | 68/205 R |
| 4,851,113 | 7/1989 | Evans | 210/400 |
| 4,874,468 | 10/1989 | Sbaschnigg et al. | 210/400 X |
| 4,908,136 | 3/1990 | Chou et al. | 210/400 |

*Primary Examiner*—Frankie L. Stinson
*Attorney, Agent, or Firm*—Breiner & Breiner

[57] ABSTRACT

The procedure for impregnating a woven or non-woven, knit, fiber sheet with an aqueous liquid, in particular of the kind containing a treatment agent, is characterized in that it consists of: (i) depositing the sheet 6 on a liquid-permeable, endless cloth 4, (ii) pouring by gravity the liquid in the form of a curtain or lamina onto the sheet and transversely to the direction of advance of this sheet, (iii) generating by means of a vacuum slit 13 mounted underneath the cloth sufficient pressure drop that at least part of said liquid shall pass through the sheet, the rate of poured liquid as defined in relation to the weight of the sheet moving underneath said curtain exceeding a specific value beyond which the entrainment rate is a function of said pressure drop but independent of the amount poured so as to make possible homogeneous impregnation and easy control of the entrainment rate.

12 Claims, 1 Drawing Sheet

IMPREGNATION PROCEDURE FOR A TEXTILE SHEET

Figure 1:
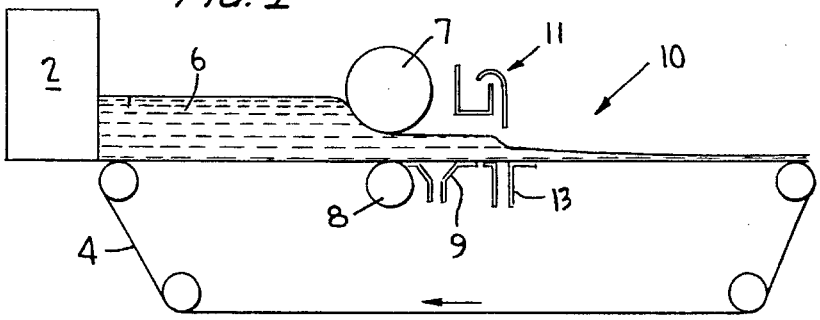

The invention concerns a procedure for continuously impregnating a fibrous sheet, such as a woven cloth, a knit, or a non-woven, said sheet consisting of natural, synthetic or artificial fibers, whether in pure form or in mixtures, linked or not, using an aqueous liquid in particular of the kind containing a processing agent, latex, finishing agent, dye, etc.; and in particular the object of the invention is the impregnation of an unbleached cotton sheet for the purpose of treatment, for instance boiling-out and/or bleaching.

The chemical treatment of unbleached-cotton fibers begins with boiling-out, which consists, following opening and mechanical cleaning, in removing the fatty and waxy sheath cladding said fibers in order to make them hydrophilic. Following rinsing and squeezing, the chemical treatment as a rule will be terminated by bleaching. Until recently, cotton was treated in lots and in a discontinuous manner, but presently it is desired to carry out all operations continuously, that is, forming a continuous sheet and moving the cotton on a belt through a sequence of stations wherein this cotton is consecutively subjected to all the stages of its treatment.

One of the difficulties incurred with this kind of procedure concerns impregnating the sheet with the various liquors. The quality of impregnation determines the quality of the finished product.

In the first place, a given quantity of a boilingout agent, soda for instance, must be incorporated into the sheet and then is made to react by being heated in the vaporizer. In order that boiling-out be at maximum efficiency, the sheet preferably shall be impregnated homogeneously with a controlled amount of liquor. This determines the time of reaction, the effectiveness and the final properties. Moreover, in order that the totality of fibers composing the sheet be treated uniformly, the impregnation itself must be homogeneous. Lastly, the means used to apply the liquid should perturb as little as possible the arrangement of the fibers so that, at the end of treatment, a product is obtained which, where called for, may be used as such without having to rework the sheet.

Applicant's known means preclude achieving the above objects.

Illustratively, the treatment liquid may be atomized onto the moving sheet by means of batteries of fluid jets. However, short of a high jet pressure that thereby modifies the sheet's structure, such a solution does not allow satisfactory wetting of the sheet when the fibers are not hydrophilic. This is the case for unbleached cotton because then the liquid penetrates only with difficulty and does not pass through the cotton. Also, uniform atomization along the entire width of the sheet is difficult to achieve, and this atomization may be ampler where the jets overlap or, on the contrary, may be sparser in the gaps between the jet impacts. To palliate those drawbacks, the number of batteries must be increased, and the apparatus accordingly becomes more complex.

Another known method consists in impregnating the sheet in a tub containing the impregnating liquor, in making sure that the fibers are wetted, and lastly in eliminating the excess liquid by moving the sheet through a mangle. This technique ensures satisfactory impregnation. However, when the textile lacks cohesion, it is likely to be warped by the mechanical action exerted on the fibers, irregularities will be produced, and air occlusions, which in the end preclude use of the product as such.

The object of the invention is to remedy these drawbacks by using an impregnation procedure for a textile sheet by means of an aqueous liquid, in particular of that type which contains a processing agent, said procedure being characterized in that the sheet is deposited on an endless, liquid-permeable support belt, said liquid is gravity-poured on the sheet in the form of a fluid curtain or lamina transverse to the sheet's direction of advance, by means of a suction slit underneath the cloth, a partial vacuum, i.e., a pressure drop, sufficient to make at least part of the liquid cross the sheet, the rate of poured liquid relative to the weight of the sheet moving underneath said curtain being larger than a specified ratio beyond which the entrainment rate is a function of said pressure drop but independent of the poured quantity in such manner as to allow homogeneous impregnation and easy control and monitoring of the entrainment rate.

The procedure of the invention offers the following advantages:

It allows uniform impregnation across the entire width being treated by applying the liquid in the form of a continuous curtain spreading the same rate of liquid over the entire width.

By its inertia, the liquid mass very effectively expels the air trapped between the fibers. This liquid mass is assisted in this action by the suction generated underneath the cloth. In this manner, it ensures fiber wetting through the entire thickness.

The suction slit takes over the role of squeezing the excess liquid out of the sheet. Contrary to the case of the conventional mangle, this squeezing is carried out in the absence of compression or contact with mechanical parts and, therefore, does not cause significant fiber shifting or disturb their arrangement. The danger that the sheet will be warped is low.

Because the slit is preferably facing the liquid curtain, it exerts a suction force on this curtain and contributes to stabilizing its flow and to ensure flow distribution across the entire width of the sheet.

By its inertia, the liquid flow imparts some energy to the sheet which increases the sheet's cohesion. It is surprisingly observed in this respect that a sheet of initially unlinked cotton fibers may be subjected to the handling entailed in its subsequent treatment without being damaged thereby. The sheet will not break or warp. The appearance of the sheet and its mechanical strength at the end of the hydrophilic and bleaching treatment are such that this sheet can be used as a finished or semi-finished good.

The procedure of the invention furthermore allows controlling of the sheet's liquid entrainment-rate. Be it borne in mind that the squeezing rate equals the proportion of residual liquid following drying in relation to the weight of the sheet. This objective is achieved by pouring such an amount of liquid on the sheet that the rate of the poured liquid relative to the weight of the sheet (see definition in the Examples further below) exceeds a specified ratio beyond which the squeezing rate depends on the pressure drop generated by the suction slit but is independent of the amount poured.

Surprisingly, it was discovered that beyond a given rate of liquid poured on the sheet, the squeezing rate no longer depends on the rate of supplied liquid but solely on the pressure drop. The squeezing rate then depends only on one parameter and is more easily monitored, in particular, inside a range from 40% to 400%. By regulating the rate of pouring beyond this threshold, impregnation as well as the uniformity of ensuing treatment are easily and satisfactorily controlled. Illustratively, should there be excessive variations in the speed of advance of the sheet, the pouring rate shall vary, but not the entrainment rate. The same applies when the sheet mass varies.

In practice, this threshold is determined empirically. It relates to a pouring rate between 300% and 1,500%. Given the same liquid, the threshold depends on the kind of fibers, the weight of the sheet and on its structure, that is, whether compressed or open, whether it is a cloth, a knit or a non-woven. For instance, for a nonbleached cotton carded sheet of 250 g/m$^2$ which is impregnated with an aqueous boiling-out solution, the threshold is about 600%.

For an unlinked fiber sheet such as a sheet of unbleached cotton, the entrainment rate may then be made to vary between 150% and 400%, preferably between 250% and 300%.

The object of the procedure of the invention essentially is to impregnate a textile sheet of unlinked fibers with a specific weight between 20 and 1,000 g/m$^2$. The fibers may be of any kind, that is, they may be natural, synthetic or artificial. They may be of one kind or in mixtures. The sheet may be formed by any suitable means, mechanical or pneumatic. Where called for the sheet may be compound and be made from two or more webs which may or may not be associated with pneumatically formed webs. Aside from unlinked fiber sheets, the procedure of the invention also applies to impregnating linked textiles such as fabrics, knits and others.

Another object of the present invention is a liquid-feeding apparatus ensuring a continuous and as uniform as possible a curtain of liquid. This is achieved using liquid feed means comprising a spout with a flow surface pointing toward the sheet and with a width at least equal to the area to be impregnated.

In a preferred embodiment, the spout consists of a cross-sectionally cylindrically convex sheet metal of which the downstream edge is serrated to facilitate detachment of the liquid curtain.

In particular, the laminar flow is improved by providing grooves in the region of the side edges.

Another object of the invention is to improve the impregnation of a sheet of unlinked fibers which rests on a porous belt, using mechanical or pneumatic means for this purpose. This goal is achieved by compressing the sheet, in particular mechanically, so as to reduce its thickness before it moves underneath the liquid curtain.

In a particular embodiment, said compression means is a compression roll.

Compaction of the sheet is further improved by mounting a vacuum slit directly downstream of the compaction means so as to avert that the sheet expands before it passes through the impregnation means.

Another object of the invention is to design a continuous boiling-out and bleaching method for unbleached cotton fibers to allow making a processed cotton sheet offering sufficient mechanical strength and homogeneous appearance for the sheet to be usable as such without further mechanical treatment other than cutting or without further processing into a finished product.

This goal is achieved by carrying out at least one of the impregnation operations of the technique of the invention.

In particular in this technique, at least the first impregnation of the treatment includes a liquor containing a boiling-out agent. Thanks to the procedure of the invention, not only shall the impregnation be homogeneous at a controlled squeezing rate, but furthermore and before any further treatment, the sheet is strengthened by the curtain's action on the fibers, in the manner described above, without thereby degrading the quality of the sheet made by the upstream forming system.

Because of this strengthening, the sheet may be handled, shipped, treated, rinsed, and squeezed, without danger of breaking or warping. Moreover, thanks to the quality of its appearance, the sheet can be directly transformed into a finished product without need for recarding or reworking it.

Other features and advantages are elucidated in the following description of an illustrative and non-limiting implementation of the invention and in relation to the attached drawings.

FIG. 1 schematically shows an impregnation procedure for a cotton sheet.

Figure 2:
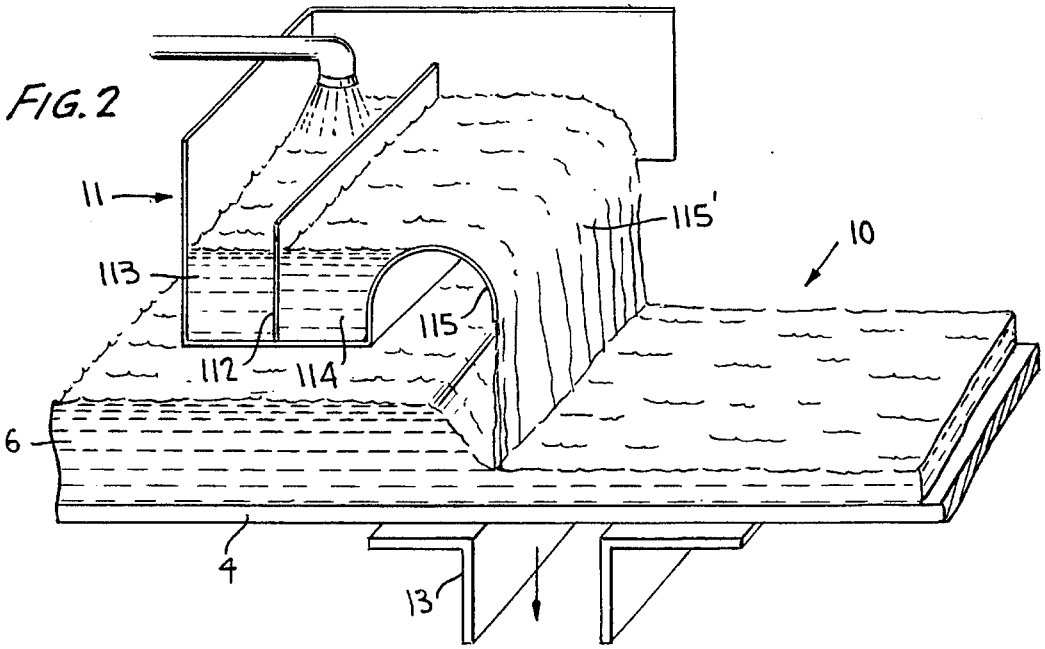

FIG. 2 is a perspective of a liquid feed system.

Figure 3:
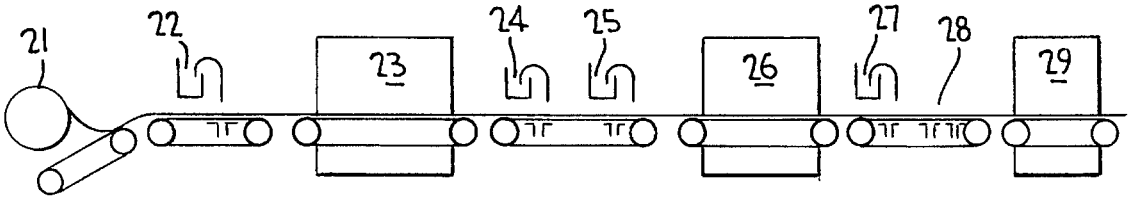

FIG. 3 schematically shows equipment for boiling-out and bleaching unbleached cotton fibers.

Figure 4:
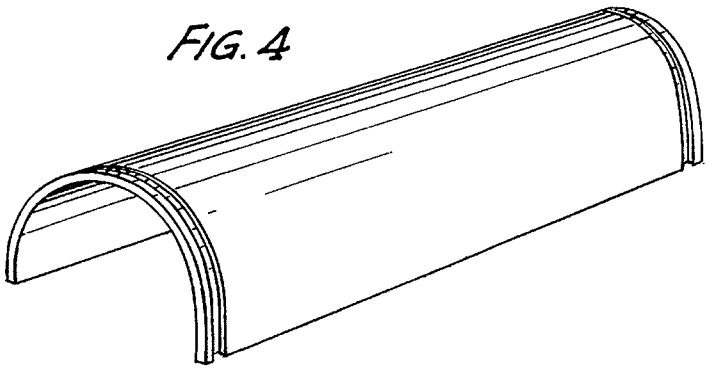

FIG. 4 is a perspective view of a spout having grooves at its side edges in the direction of fluid flow.

FIG. 1 schematically shows impregnation equipment of the invention for treating for instance a sheet of unbleached, unlinked cotton fibers.

A forming system schematically indicated by the sub-assembly 2 deposits the individual and open fibers on an endless belt 4 driven into planar translation as shown by the arrow. The belt is porous; this may be a suitably perforated impermeable material or a linen cloth. The belt is tensioned between horizontal rolls of which one is the drive means. The sheet 6 leaving the forming system is comparatively thick and uniform.

A compression roll 7 is rotatably mounted downstream on a horizontal axis transversely to the direction of advance and cooperates with a matching roll 8 resting against the cloth and functions to partly expel air from the sheet and thus to reduce its thickness. It is important that the air be expelled because otherwise they form pockets that would oppose the subsequent penetration by the liquid. Directly downstream of the compaction means, a pressure drop exists underneath the sheet by means of a first suction slit 9 to prevent the sheet from intrinsically inflating again on account of the elastic restoring forces from the fibers themselves. Also, the pressure drop forces the fibers against the cloth and enhances the subsequent action of the liquid. The slit 9 communicates with a vacuum source omitted from the drawing. The sheet leaving this compaction means underwent no transformation other than a reduction in its height. Its homogeneity remains uninterrupted. Illustratively, a sheet of unbleached cotton which depending on its specific weight and the forming method evincing a thickness between 40 and 150 mm is in this manner compacted to a height between 10 and 30 mm. Again, compaction may be achieved by a pressure drop generated underneath the sheet in lieu of using a mechanical means.

Next, the sheet moves into the actual impregnation apparatus 10. This apparatus 10 consists of two components: a liquid feed 11 and a suction means 13.

The apparatus 10 is designed to supply the liquid in the form of a curtain or lamina which is transverse to the direction of advance of the sheet, the liquid being set in motion merely by gravity. The expression "curtain" denotes a uniform and continuous distribution of the liquid in the transverse direction. A suction means 13 in the form of a suction slit of a given width is mounted plumb with the liquid's impact zone, its pressure drop being selected in such a manner that the squeezing rate of the liquid in the sheet can thereby be controlled.

FIG. 2 is an illustrative perspective of the apparatus 10 sectioned in the direction of advance of the belt 4 and shows that the feed 11 includes a liquid accumulation zone divided into two compartments 113, 114 by a transverse partition 112 with orifices through which said two compartments 113, 114 may communicate. The first compartment is supplied with liquid from a conduit and in turn it supplies the compartment 114. This design allows reducing turbulence within this latter compartment. A cylindrically convex spout 115 with horizontal generatrices perpendicular to the direction of advance of the sheet is mounted on the external wall of said latter compartment. The free edge of the spout is serrated, i.e., it is provided with pointed projections 115' extending along its surface for the purpose of enhancing liquid detachment from the spout surface. The spout curvature is selected in such a way that the overflow liquid from the compartment 114 is laminar with flow filaments as parallel as possible. Preferably, the tangent to the spout at its free edge shall be substantially vertical. The surface condition furthermore must also be taken into consideration. To reduce perturbations, it shall be chosen to be smooth. Accordingly, the spout flow forms a continuous and substantially planar curtain in its transverse direction. In order to lessen the constriction of the liquid curtain between its spout and its impact on the sheet, fine grooves may be provided near the side edges of the spout which point in the direction of the fluid filaments, or else guide baffles may be provided from which the fluid filaments shall not detach.

A suction slit 13 is present underneath and parallel to the belt 4 and plumb with the spout 115 and communicates with a vacuum source. The size of the suction slit is determined in such manner that the suction shall be effective over a long enough time when the sheet passes overhead. Accordingly, said slit extends downstream of the spout over a distance determined by the kind of advance of the sheet.

The pressure drop generated by the slit is selected to be sufficient to dry the sheet. Moreover, it was found that the sheet's squeezing rate can be controlled by solely regulating the magnitude of the pressure drop once the liquid flow exceeds a threshold.

This feature is illustrated in the following Examples.

EXAMPLE 1

A cotton sheet of a width 0.56 m(L) and with a dry specific weight (M) of 250–260 g/m$^2$ was prepared and deposited on a belt moving at a speed (V) of 25 m/min. By means of the above described equipment, slightly colored water was applied. The width of the suction slit was 30 mm and the pressure drop was 90 mb (relative vacuum). The flow (D) of the poured water was progressively varied. It was found that beyond a threshold (Td) of poured water, which corresponds to about 600%, the squeezing rate (E) or entrainment rate, varies very little. The curve Td=f(E) becomes asymptotic.

The pouring rate (Td) is the percentage ratio of the mass of applied liquid to the mass of the fibers moving underneath the mass of said liquid, namely $$Td = \frac{D \times 1{,}000 \times 100}{60 \times L \times V \times M}$$

$$E = \frac{\text{humid mass} - \text{dry mass} \times 100}{\text{dry mass}}$$

| FLOW (ltr/h) | 550 | 1,200 | 1,570 | 1,800 |
|---|---|---|---|---|
| Pouring rate (%) | 260 | 570 | 750 | 860 |
| (M = 250 g/m$^2$) Squeezing rate | 215% | 275% | 290% | 285% |

EXAMPLE 2

A viscose-fiber, needled non-woven is treated in the same manner as for Example 1.

M=145 g/m$^2$

V=25 m/min

Pressure drop: 85 mbar

The change in the squeezing rate (E) as a function of the pouring rate is shown in the table below:

| Td (%) | 310 | 380 | 500 | 670 | 920 | 1,270 | 1,565 | 1,900 |
|---|---|---|---|---|---|---|---|---|
| E (%) | 142 | 152 | 163 | 178 | 190 | 197 | 200 | 205 |

By plotting E=f(Td), the threshold beyond which E varies only slightly can be determined. In this example, it is between 1,000 and 1200%.

EXAMPLE 3

A cotton jersey is treated in the same manner as in Example 1.

M=140 g/m$^2$

V=25 m/min

Pressure drop: 90 mbar

| Td (%) | 325 | 430 | 685 | 891 | 1,400 |
|---|---|---|---|---|---|
| E (%) | 39 | 51 | 60 | 62 | 62 |

The threshold is graphically determined to be about Td=600%.

EXAMPLE 4

The following Examples illustrate how to control the squeezing rate or entrainment (in %) as a function of the pressure drop δP generated underneath the sheet for three different kinds of sheets.

Solution: water+wetting agent (5 g/ltr)

Rate: 1,200 ltr/h, width=0.5 m

Speed: 3 m/min

Slit: 30 mm, ie a suction time of 0.6 s. Beyond this magnitude, the suction time practically no longer affects the squeezing rate.

115 g/m$^2$ CLOTH

Liquid pouring rate: 1,390%

| δP (mb) | 44 | 50 | 69 | 80 | 88 |
|---|---|---|---|---|---|
| E (%) | 100 | 94 | 87 | 76 | 73 |

140 g/m$^2$ KNIT

Liquid pouring rate 1,140%

| δP (mb) | 38 | 42 | 55 | 64 | 76 | 84 |
|---|---|---|---|---|---|---|
| E (%) | 119 | 117 | 104 | 87 | 77 | 70 |

250 g/m$^2$ UNBLEACHED COTTON SHEET

Liquid pouring rate: 570%

| δP (mb) | 42 | 50 | 65 | 74 | 85 | 92 |
|---|---|---|---|---|---|---|
| E (%) | 450 | 350 | 320 | 290 | 280 | 275 |

Complete equipment for bleaching unbleached cotton fibers by using the impregnation procedure of the invention is described below in relation to FIG. 3.

The bleaching method consists in opening, cleaning, and, where called for, mixing cottons of different origins and qualities, and in forming at 21 a sheet between 50 and 1,000 g/m$^2$, preferably between 100 and 600 g/m$^2$, by any suitable means, mechanical (card) and/or pneumatic.

This sheet is supported and driven by a belt through the different treatment stations.

The sheet is impregnated at 22 using the equipment of the invention and with a boiling-out solution (soda and wetting agent) while the squeezing rate is controlled by means of the pressure drop created at the suction slit. The pressure drop is about 100 mbars.

The sheet is inserted into a vaporizer 23 heated to about 100° C. and stays in it, remaining continuous thanks to a suitable storage device, for a time which is determined as a function of the liquor and the entrainment rate.

Next, the sheet is rinsed and the boiling-out liquid is extracted using a second liquid curtain 24 and a vacuum slit associated with a mean pressure drop of 100 to 350 mbars.

The boiled-out, hydrophilic sheet is impregnated with a bleaching solution (water substantially oxygenated using soda) in a third assembly 25 of liquid curtain and vacuum slit.

The sheet is inserted again into a vaporizer 26 heated to about 100° C. where it stays thanks to a suitable storage device for a time sufficient for effective bleaching.

Thereupon, the sheet is rinsed using a sequence of liquid curtains associated with suction slits, 27.

Lastly, the maximum water contained in the sheet is extracted at 28 and the sheet is dried in an oven 29 which, preferably, operates with air drafts.

The sheet may be used directly in manufacturing packed, hydrophilic cotton or else it may be converted into fibers following shredding to make non-woven products.

The invention is not restricted to the above discussed embodiment modes. It includes all equivalents and any application within the reach of the expert.

We claim:

1. A process for impregnating a fibrous sheet with an aqueous liquid comprising placing a fibrous sheet onto a liquid-permeable endless belt; impregnating the fibrous sheet with an aqueous liquid; and passing the impregnated fibrous sheet on said belt over a suction means which provides a sufficient pressure drop so as to cause at least a part of said aqueous liquid to pass into the fibrous sheet; wherein in said impregnating of said fibrous sheet with an aqueous liquid, the aqueous liquid is poured onto said fibrous sheet by gravity in the form of a liquid curtain which is transverse to the direction of advance of said fibrous sheet on said belt; wherein the pouring of said aqueous liquid is at a rate, said rate being relative to the weight of the fibrous sheet moving under the liquid curtain, which exceeds a threshold amount which is such that the rate of liquid entrainment in the fibrous sheet depends on said pressure drop and is independent of the amount of liquid poured, and thereby provides a homogeneous impregnation of said fibrous sheet and controls said rate of entrainment during the impregnation absent use of mechanical roller means and wherein said threshold of the rate of poured liquid is between 300%–1500% and said rate of entrainment is between 40%–100%.

2. Process according to claim 1 wherein said aqueous liquid includes a fiber treatment agent.

3. Process according to claim 1 wherein the liquid curtain is provided by a liquid feed comprising a spout having a width at least equal to the width of said fibrous sheet and which spreads the liquid into a continuous curtain.

4. Process according to claim 3 wherein the spout is of a cross-sectionally convex cylindrical sheet metal having a downstream edge which is serrated.

5. Process according to claim 3 or claim 4 wherein the spout includes grooves running in the direction of liquid flow on said spout near the side edges of the spout.

6. Process according to claim 1 wherein said fibrous sheet is formed of unlinked fibers and said rate of entrainment is between 150%–400%.

7. Process according to claim 1 wherein said fibrous sheet is formed from unlinked fibers by a mechanical and/or wind means from fibers in bulk and then placed on said endless liquid-permeable belt and the sheet reduced in thickness by a compaction means.

8. Process according to claim 7 wherein the specific weight of the sheet is between 20–1000 g/m$^2$.

9. Process according to claim 7 wherein said compaction means is at least one compression roller.

10. Process according to claim 7 wherein said compaction means is a suction means providing a pressure drop beneath said belt.

11. Process according to claim 7 wherein a pressure drop is generated under said belt in the space between said compaction means and the impregnating of said fibrous sheet with an aqueous liquid.

12. A process for continuously treating unbleached fibers comprising opening and mechanically cleaning said fibers; forming a sheet with said fibers and placing said sheet on a liquid-permeable endless moving belt; impregnating said sheet on said belt with a boiling-out solution; subjecting said sheet to boiling-out; rinsing said sheet and extracting liquid from said sheet; impregnating said sheet with a bleaching solution; bleaching said sheet; rinsing said sheet and extracting liquid from said sheet; and drying said sheet; wherein the impregnating of said sheet in one or both of said impregnating with said boiling-out solution and impregnating with said bleaching solution is carried out absent Use of mechanical roller means by impregnating the sheet with said boiling-out solution or bleaching solution by gravity feed of the solution in the form of a liquid curtain which is transverse to the direction of advance of the sheet on said belt and passing the belt holding the sheet over a suction means which provides a pressure drop to cause at least a part of the solution to pass into the sheet in a homogeneous manner, the rate at which the liquid is poured onto said sheet exceeding a threshold amount which is between 300%–1500% and the rate of liquid entrainment in said sheet during impregnation of said sheet being dependent on said pressure drop and independent of the amount of liquid poured and is controlled absent use of mechanical roller means so that the rate of entrainment is between 40%–400%, thereby providing a homogeneous impregnation of the sheet.

* * * * *